US007156149B2

(12) United States Patent
Mergen et al.

(10) Patent No.: US 7,156,149 B2
(45) Date of Patent: Jan. 2, 2007

(54) METHOD FOR PRODUCING A STRATIFIED COMPOSITE MATERIAL

(75) Inventors: Robert Mergen, Altmünster (AT); Günter Kutzik, Gmunden (AT)

(73) Assignee: Miba Gleitlager GmbH, Laakirchen (AT)

( * ) Notice: Subject to any disclaimer, the term of this patent is extended or adjusted under 35 U.S.C. 154(b) by 0 days.

(21) Appl. No.: 11/142,146

(22) Filed: Jun. 1, 2005

(65) Prior Publication Data

US 2005/0281946 A1 Dec. 22, 2005

(30) Foreign Application Priority Data

Jun. 2, 2004 (AT) ..... A 946/2004

(51) Int. Cl.

| | |
|---|---|
| ***B22D 11/00*** | (2006.01) |
| ***B22D 19/08*** | (2006.01) |
| ***B22F 7/04*** | (2006.01) |
| ***B05D 1/12*** | (2006.01) |

(52) U.S. Cl. ..... 164/461; 164/103; 427/180; 419/8

(58) Field of Classification Search ..... 164/461, 164/419

See application file for complete search history.

(56) References Cited

FOREIGN PATENT DOCUMENTS

| | | | |
|---|---|---|---|
| EP | 0709491 | | 5/1996 |
| GB | 2383051 | | 6/2003 |
| JP | 61-49749 | * | 3/1986 |
| JP | 61-49750 | * | 3/1986 |
| JP | 2003183707 | | 7/2003 |
| WO | WO9429490 | | 12/1994 |
| WO | WO9936210 | | 7/1999 |

* cited by examiner

*Primary Examiner*—Kuang Y. Lin
(74) *Attorney, Agent, or Firm*—Collard & Roe, P.C.

(57) ABSTRACT

A method is described for producing a stratified composite material, with a layer of sinterable solids particles being applied to a strip-like metal carrier and being sintered with liquid phase by the supply of heat continuously in the forward feed direction. In order to provide simplified production conditions it is proposed that the metal carrier is heated continuously in the forward feed direction with a temperature profile which decreases towards lower temperatures from a maximum temperature above the melting temperature of the solids particles in the region of a surface layer receiving the particle layer towards a core layer of the metal carrier, and that the particle layer is sintered at least in a layer resting on the metal carrier by a heat transmission from the heated metal carrier.

4 Claims, 2 Drawing Sheets

METHOD FOR PRODUCING A STRATIFIED COMPOSITE MATERIAL

FIELD OF THE INVENTION

The invention relates to a method for producing a stratified composite material, wherein a layer of sinterable solids particles is applied to a strip-like metal carrier and is sintered in a liquid phase by the supply of heat continuously in a forward feed direction.

DESCRIPTION OF THE PRIOR ART

It is known (GB 2,383,051A) to produce a stratified composite material, which consists, for example, of a steel carrier and a copper based layer material and which is used for slide bearings, by sintering the layer material which is applied to the steel carrier in powder form and to melt with the help of laser beams the powder of the layer material sprinkled onto the steel carrier over the width of the strip-like steel carrier in a locally limited longitudinal region. The same is then rapidly cooled from the side of the steel carrier in order to achieve an outwardly progressing solidification of the layer material, starting from the surface of the steel carrier with a fine-grained, dendritic structure. Although this method for producing a stratified composite material can be used to considerably reduce the length of a required installation in comparison with conventional systems for sintering stratified composite materials, the high complexity of the system remains, due to the required use of laser devices over the width of the strip-like steel carrier.

SUMMARY OF THE INVENTION

It is an object of the invention to provide a method for producing a stratified composite material of the kind mentioned above in such a way that the advantages of sintering in a liquid phase which progresses in the forward feed direction and is limited to a short longitudinal region can be utilized without having to heat the respective layer of the layer material to sintering temperature with the help of laser devices.

This object is achieved by continuously heating the metal carrier in the forward feed direction with a temperature profile which decreases from a maximum temperature above the melting temperature of the solids particles in the region of a surface layer receiving the particle layer towards a core layer of the metal carrier, and sintering the particle layer on the metal carrier by heat transmission from the heated metal carrier. Since the heated metal carrier temperature drops from the maximum temperature towards the core layer, it is possible, despite the heating of the solids particles of the layer material to the sintering temperature required for a sintering in a liquid phase by heat transmission from the metal carrier, to ensure an outwardly progressing solidification of the liquid phase starting from the surface of the metal carrier. The melting heat withdrawn from the metal carrier close to the surface leads to a cooling of the metal carrier close to the surface, and in conjunction with the temperature drop, to a solidification of the liquid phase progressing from the inside to the outside. The temperature drop should be at least 5° K/mm in order to ensure the desired effect.

Due to the penetration depth of an electromagnetic alternating field into a strip-like metal carrier which depends on the frequency, the desired temperature profile for the heating of the metal carrier can be achieved advantageously by an inductive heating, since different field densities can easily be set by a suitable arrangement of the windings of an inductive coil in the region of the opposite surfaces of the strip-like metal carrier or by a winding arrangement on one side. In this way it is possible to continuously heat the metal carrier in the forward feed direction with the desired temperature profile in order to transmit the melting heat from the metal carrier onto the applied particle layer which is required for the sintering of the solids particles in a liquid phase. The particle layer can be produced with conventional sintering powders. It is also possible to use coarse-grained materials or granulates without endangering the desired sintering by heat transmission from the metal carrier.

The thermal energy required for the sintering of the solids particles over the entire layer thickness does not have to be produced completely through the heating of the metal carrier. The particle layer applied onto the metal carrier can be additionally heated in an inductive way during the sintering process, so that merely a layer of the solids particles resting on the metal carrier is sintered by a heat transmission from the heated metal carrier in a liquid phase. With the melting of a partial layer of the solids particles, eddy currents can be induced in this molten partial layer which ensure additional heat in order to accelerate the sintering process to the outside. The solidification of the sintering material initiated through the cooled metal carrier is not affected thereby, so that even thicker layer materials can be readily sintered. This is of subordinate importance with respect to the stratified composite materials for slide bearings however. Moreover, the solids particles can be preheated prior to sintering in order to make do with a lower thermal energy in the region of the metal carrier.

BRIEF DESCRIPTION OF THE DRAWINGS

The method in accordance with the invention will be explained below by reference to the drawings, wherein.

DESCRIPTION OF THE PREFERRED EMBODIMENTS

Figure 1:
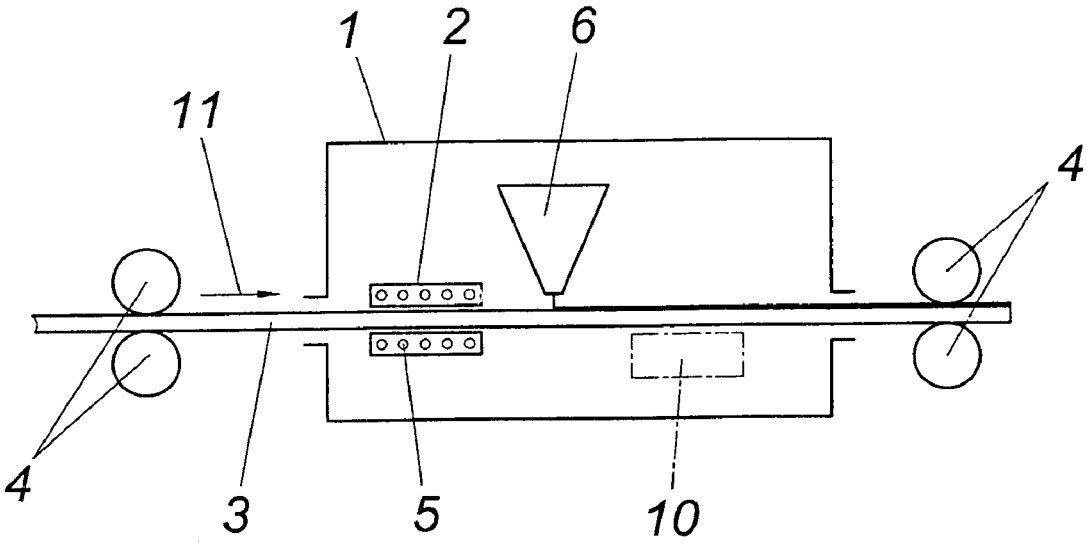
FIG. 1 shows an apparatus for producing a stratified composite material according to the method in accordance with the invention in a schematic longitudinal sectional view.

According to the embodiment according to FIG. 1, a device 2 for the inductive heating of a strip-like metal carrier 3 is provided within a protective hood 1 for maintaining an atmosphere of inert gas, which carrier is conveyed with the help of driving rollers 4 through the protective hood 1 and is heated on passing through the windings 5 of at least one inductive coil before solids particles (e.g. a sintering powder) is applied onto the metal carrier 3 from sprinkling device 6.

Figure 3:
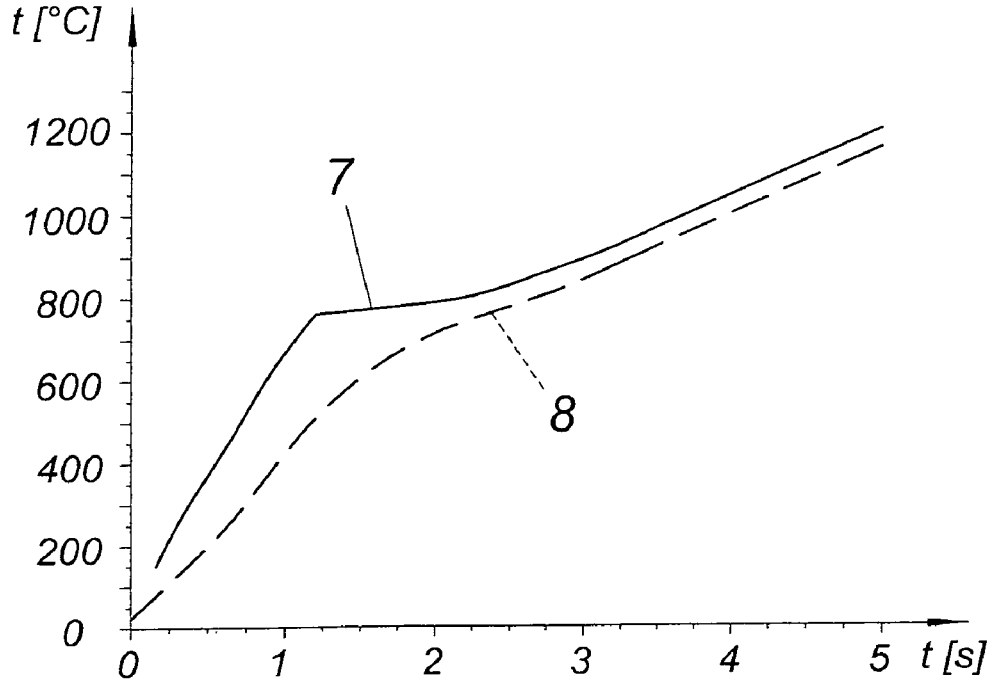
FIG. 3 shows the temperature curve over time during the inductive heating of the metal carrier in a surface layer and in a core layer.
Figure 4:
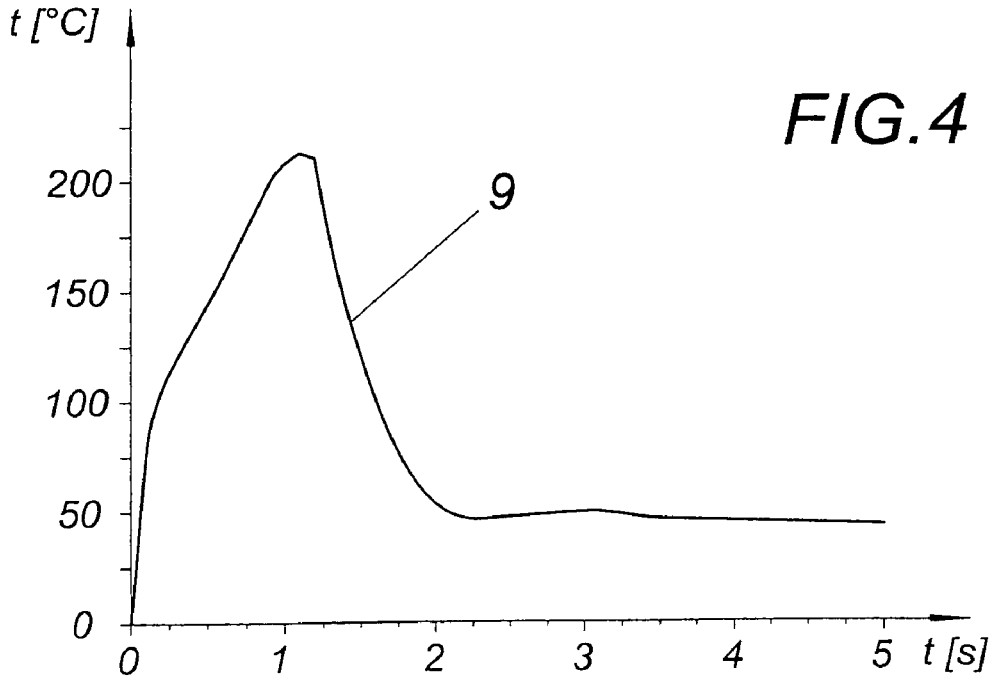
FIG. 4 shows the temperature drop between a surface layer and a core layer of the metal carrier during the heating according to FIG. 3.

FIG. 3 shows the curve over time for a steel metal carrier 3 with a thickness of 5 mm in a surface layer and in a core layer. The curve 7 of the surface temperature shows that, at a suitable field frequency of 200 kHz for example, the surface temperature of the metal carrier 3 rises only gradually after exceeding the Curie point. However, with a suitable energy supply, the necessary maximum temperature of 1100° C. to 1200° C. which lies above the melting temperature of the solids particles can easily be reached within a time frame of 4 to 5 seconds. As a result of the penetration depth of the magnetic alternating field which depends on the excitation frequency, the core temperature follows the surface temperature of the metal carrier 3 according to the curve 8 with a time delay, so that within the metal carrier 3 a temperature profile is obtained with a temperature drop from a maximum temperature in a surface layer to lower temperatures in a core layer. The temperature difference between the temperature curve 7 in the surface region and the temperature curve 8 in the core region is shown in FIG. 4 on a larger scale as curve 9. It can be seen that, although after exceeding the Curie point the temperature difference between the surface and the core decreases, this temperature difference does not fall below 50° C. under the predetermined conditions in the region of the desired end temperature. This means that after heating the metal carrier 3 to a surface temperature exceeding the melt temperature of the solids particles, a sufficient temperature gradient is obtained in the direction of the core layer of the metal carrier 3, so that despite the transmission of the melting heat from the metal carrier to the particle layer and the thus linked sintering of the layer material in a liquid phase, the solidification of the molten solids particles starts from the surface of the metal carrier 3 and progresses to the outside. The cooling of the molten solids particles initiated through the occurring temperature gradients can be supported by a cooling of the metal carrier 1 from the side averted from the layer material, as shown by a cooling device 10 in FIG. 1.

Since the metal carrier 3 is progressively inductively heated in a forward feed direction 11, with the heating zone being limited to a short length determined by the inductive heating device 2 and with the sprinkled particle layer also being sintered in a limited length section in a liquid phase and thereafter cooled, a comparatively short overall length is obtained for the sintering apparatus, which thus ensures that not only metal carrier strips but also plates can be provided for producing stratified composite materials.

Figure 2:
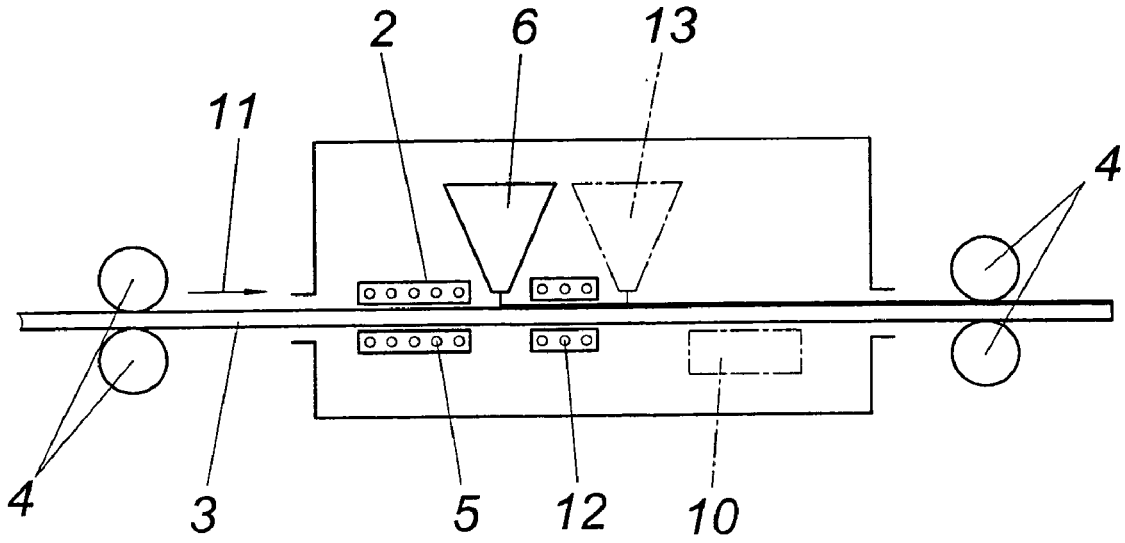
FIG. 2 shows a different embodiment of an apparatus for producing a stratified composite material.

The embodiment in accordance with FIG. 2 corresponds substantially to that of FIG. 1. In contrast to the embodiment according to FIG. 1, the device 2 is associated with an additional coil with windings 12 which are provided downstream of the sprinkling device 6 in the forward feed direction 11 and is configured in such a way that it is not necessary to transmit the entire melting energy for the particle layer via the metal carrier 3 onto the particle layer. It is understood that such additional induction windings 12 also allow a subsequent sprinkling of solids particles, as is indicated by the sprinkling device 13 shown by the dot-dash line.

It is understood that the invention is not limited to the illustrated embodiments because the sintering process and the formation of the layer material may be influenced by the coil arrangement as well as the sprinkling of the solids particles. Since there are no limitations both with respect to the pre-treatment of the metal carrier 3 as well as with respect to the after-treatment of the stratified composite material in connection with the method in accordance with the invention, the conventional pre-treatments and after-treatments will not be discussed.

The invention claimed is:

1. A method for producing a stratified composite material comprised of a metal carrier and a layer material, which comprises the steps of (a) continuously heating the metal carrier in a forward feed direction and applying a layer of solids particles on a surface layer of the heated metal carrier, the metal carrier being heated with a temperature profile whose temperature decreases from a maximum temperature above the melting temperature of the solids particles in the region of the surface layer to a core layer of the metal carrier, and (b) sintering the layer of solids particles in liquid phase by transmitting the heat of the metal carrier to the layer of solids particles on the surface layer of the heated metal carrier.

2. The method of claim 1, wherein the temperature profile has a drop of at least 5° K/mm from the surface to the core layer of the metal carrier.

3. The method of claim 1, wherein the metal carrier is heated inductively with the temperature profile.

4. The method of claim 1, wherein the metal carrier is additionally inductively heated during sintering the layer of solids particles.

* * * * *